US007627934B2

(12) United States Patent
Williams

(10) Patent No.: US 7,627,934 B2
(45) Date of Patent: Dec. 8, 2009

(54) METHOD AND APPARATUS FOR TIGHTENING A BELT

(76) Inventor: Lavell Devon Williams, 2408 29th St., Lubbock, TX (US) 79411

( * ) Notice: Subject to any disclaimer, the term of this patent is extended or adjusted under 35 U.S.C. 154(b) by 116 days.

(21) Appl. No.: 11/801,752

(22) Filed: May 10, 2007

(65) Prior Publication Data

US 2008/0276437 A1 Nov. 13, 2008

(51) Int. Cl.
*A01K 73/12* (2006.01)

(52) U.S. Cl. ..... 24/598.2; 24/598.3; 24/598.5; 114/114; 43/14

(58) Field of Classification Search ..... None
See application file for complete search history.

(56) References Cited

U.S. PATENT DOCUMENTS 1,203,442 A * 10/1916 Wister ..... 190/27
1,395,103 A * 10/1921 Goebel ..... 81/3.57

* cited by examiner

*Primary Examiner*—Jack W. Lavinder
(74) *Attorney, Agent, or Firm*—Kristopher Lance Anderson

(57) ABSTRACT

The present invention includes a method and related apparatus for tightening or loosening a belt. Some illustrative embodiments include a method and apparatus for tightening or loosening a belt used in, e.g., power-lifting, to provide adequate leverage in tightening or loosening the belt to prevent injury comprising using the apparatus (constructed with a rigid material) to attach to the belt and allowing for appropriate tension to be applied to fasten and unfasten the belt at the desired tightness.

10 Claims, 3 Drawing Sheets

METHOD AND APPARATUS FOR TIGHTENING A BELT

CROSS-REFERENCE TO RELATED APPLICATIONS

This specification is intended to supplement the provisional application Ser. No. 60/765,374, filed Feb. 6, 2006, and titled "Vise" which application is incorporated by reference herein as if reproduced in full below.

STATEMENT REGARDING FEDERALLY SPONSORED RESEARCH OR DEVELOPMENT

N/A

BACKGROUND OF THE INVENTION

1. Field of the Invention

Various embodiments are directed to methods and systems for tightening or loosening a belt and, more particularly, tightening or loosening a support belt to provide desired restraint.

2. Description of the Related Art

Efforts to alleviate back strain problems have been directed to abdominal support belts which are placed about the waist of the participants prior to engaging in an activity that possibly will introduce strains to the back. It is generally accepted that the wearing of a properly designed abdominal support belt can significantly reduce the risk of back injury, especially in combination with the practice of good body mechanics, generally accepted lifting techniques and sound physical conditioning. Properly designed belts are those belts which are fitted to the individual user in a manner which permits the selection by the user of the degree of support required for the task at hand.

Most abdominal support belts are made with double-layered heavy leather or multi-layer nylon, and most are buckled with either one (1) or two (2) notches one the tongue of the belt to provide for adjustable tightness. The buckle and tongue ends are then brought together by the user to allow for fastening at the desired tightness.

Abdominal support belts, including support belts in weightlifting, must be tightened to allow for adequate abdominal support to be obtained. Often, because of the thickness and rigidity of the support belt, the user finds it difficult to adequately tighten the belt without the use of another person. The energy put into tightening or loosening the belt often causes the user to be forced to rest prior to engaging in the proscribed activity. In addition, the user may not be able to adequately tighten or loosen the belt without another person's assistance, causing ineffective support and possible injury to the user.

To allow for the user alone to adequately tighten the support belt, some recent developments provide a ratcheting system instead of the traditional belt buckle with notches in the tongue to adjust tightness. The ratcheting systems are more expensive and are not able to be applied to traditional tongue-and-buckle belts that are preferred to many in the art.

Thus what is needed is a method and related apparatus to tighten and subsequently loosen a tongue-and-buckle abdominal support belt to an adequate tightness solely by the user without the need for assistance.

SUMMARY OF SOME OF THE PREFERRED EMBODIMENTS

The problems noted above are solved in large part by a method and apparatus for tightening a belt. Some illustrative embodiments include a method for using an implement made of rigid material to grasp the tongue portion of the belt and pull through the buckle by using a pivoting motion of the apparatus against the user's body to pull the tongue through the buckle.

Another illustrative embodiment may be the method of using the apparatus made of rigid material and fashioned to provide a means for grasping the apparatus at one end, placing the apparatus down the length of the tongue of the belt, attaching the apparatus to the tongue by using the notches available on the tongue at the median portion of the apparatus through use of one or more pegs, or male shaped protrusions, to attach to the desired notch or notches, having the proximal portion of the apparatus rest against the outside of the belt, and then pulling the distal portion of the apparatus to further tighten the tongue through the buckle, allowing for the user to then buckle the belt.

Yet another illustrative embodiment may be an apparatus comprising a proximal end, a distal end, and one or more male-shaped protrusions designed for inserting into the notches of a belt located at or near the median portion of the apparatus for the purpose of tightening the belt. The apparatus may be powder coated, painted or padded for additional durability.

Yet another illustrative embodiment may be an apparatus comprising a means for tightening a belt using an apparatus made of rigid material having a proximal and distal end and one or more male-shaped protrusions, a means for inserting the male-shaped protrusion or protrusions into the notches on the tongue of the belt, and a means for tightening the belt by exerting a pulling force on the apparatus to pull the tongue of the belt through the buckle to the desired level of tightness.

Yet another illustrative embodiment may be an apparatus comprising a means for loosening a belt using an apparatus made of rigid material having a proximal and distal end and one or more male-shaped protrusions, a means for inserting the male-shaped protrusion or protrusions into the notches on the tongue of the belt, and a means for loosening the belt by exerting a force capable of unbuckling the belt and then removing the apparatus to allow for removal of the belt.

The disclosed materials and methods comprise a combination of features and advantages which enable it to overcome the deficiencies of the prior art. The various characteristics described above, as well as other features, will be readily apparent to those skilled in the art upon reading the following detailed description, and by referring to the accompanying drawings.

BRIEF DESCRIPTION OF THE DRAWINGS

For a detailed description of the preferred embodiments of the invention, reference will now be made to the accompanying drawings, in which.

NOTATION AND NOMENCLATURE

While preferred embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

DETAILED DESCRIPTION OF THE PREFERRED EMBODIMENTS

Figure 1:
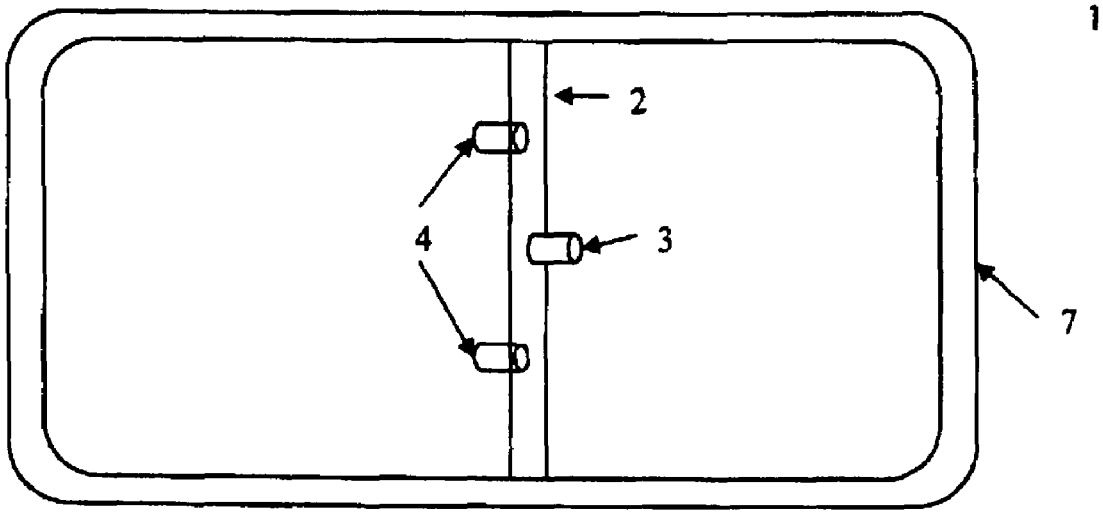
FIG. 1 illustrates a perspective view of one preferable embodiment of the apparatus used as a means for tightening or loosening a belt.
Figure 3:
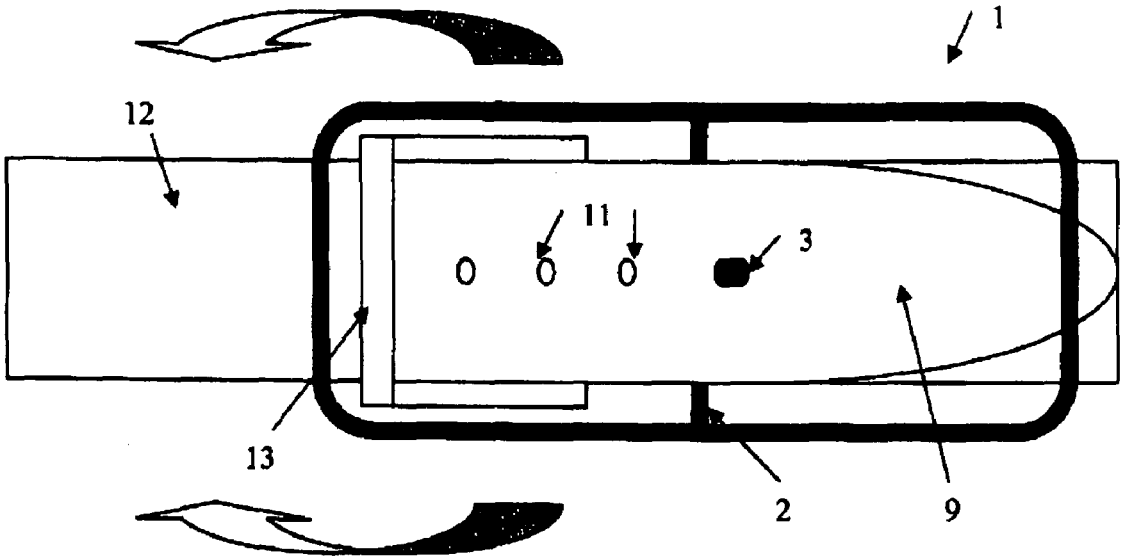
FIG. 3 illustrates a belt being tightened using the apparatus in accordance with some embodiments of the invention.

FIG. 1 illustrates a perspective view of one preferable embodiment of grasping apparatus 1. Grasping apparatus 1 preferably comprises a frame 7 with a proximal and a distal end. Frame 7 may additionally preferably comprise a central member 2 with one or more protrusions 3 securedly affixed thereto, wherein said protrusions 3 are further configured to be insertable into notches 11 as such notches 11 typically occur on a support belt 12 (FIG. 3). Protrusions 3 may optionally take the form of male-shaped pegs, which may further be formed of any variety of shapes, including but not limited to rounded, square or other polygonal forms. Said protrusions 3 are typically of a length in the range of 0.5 to 4.0 centimeters. Said protrusions may also be formed on the opposite side of grasping apparatus to provide multiple protrusions 4 for belts that have two rows of notches, or a double-buckle system. Frame 7, central member 2, and protrusions 3 may be formed of rigid materials, which include but are not limited to metals, alloys, composites, or hard plastics such as polypropylenes, HD polyethylenes, polyvinyl chlorides, polystyrenes, or any other substances or equivalents to impart suitable rigidity for the methods and apparatus described herein. These frame 7, optional central member 2 and protrusion may also optionally be forged, molded, welded, cast, fastened, extruded, and of component or uniform construction.

Figure 2:
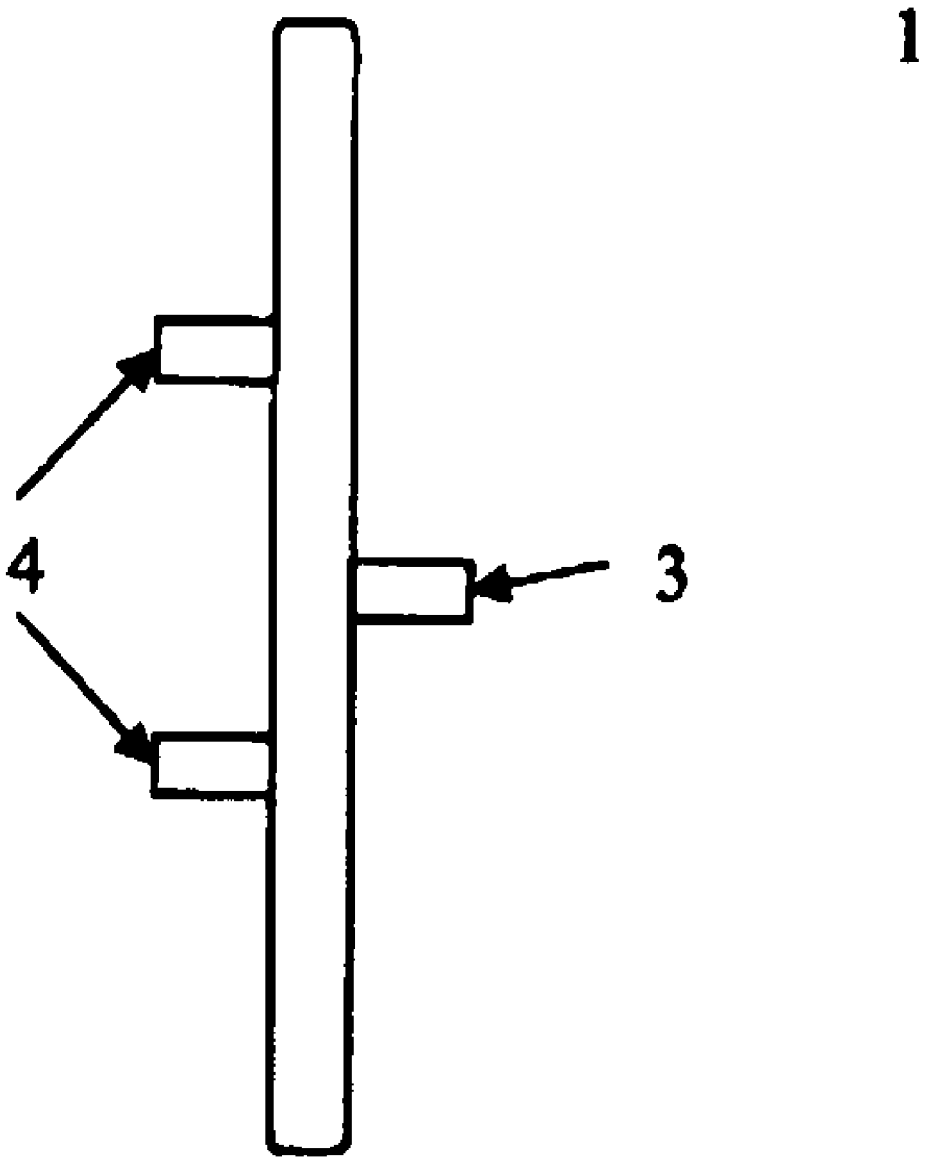
FIG. 2 illustrates a side view of one preferable embodiment of the apparatus used as a means for tightening or loosening a belt.

FIG. 2 illustrates a side perspective view of one preferable embodiment of grasping apparatus 1. In this figure, the preferable protrusions 3 are shown, where a plurality of protrusions 4 are configured in substantially opposite directions along central member 2, said configuration being one preferable arrangement of protrusion because of various notch arrangements on support belt 12. In the event of a double notch arrangement, multiple protrusions 4 are preferred.

FIG. 3 illustrates an embodiment of the grasping apparatus 1 as a user preferably operates the apparatus. A support belt 12 is shown, featuring typical tongue 9 and buckle 13, which a user would typically draw toward one another when fastening support belt 12. The support belt 12 additionally features notches 11, for receiving fastening means of buckle 13. The protrusions 3 on grasping apparatus 1 are adapted to insert into such notches 11. After such insertion, a user may preferably operate the apparatus 1 by a pivoting action of proximal and distal sides of said apparatus to accomplish loosening or tightening of said support belt 12.

What is claimed is:

1. A method for tightening a support belt for lifting weight using a apparatus comprising the steps of:

placing said apparatus adjacent a buckle of said support belt, wherein said apparatus comprises a proximal and distal end, a central member, and one or more protrusions located on said central member, and said support belt comprises a tongue portion, a buckle, and one or more notched openings on said tongue portion;

inserting said one or more protrusion(s) into said notch openings, thereby attaching said grasping apparatus to said supporting belt;

positioning said proximal end against the outside of said supporting belt;

tightening said support belt by grasping said distal end of said grasping apparatus;

pulling said tongue portion through said buckle; and buckling said support belt.

2. The method of claim 1, wherein said frame comprises at least one of metal, alloy, composite, polypropylene, high density polyethylene, polyvinyl chloride, polystyrene, and combinations thereof.

3. The method of claim 1, wherein said one or more protrusion(s) is adapted to take on a variety of shapes comprising round, square or other polygonal forms.

4. The method of claim 1, wherein said one or more protrusions are positioned on opposite sides of said central member.

5. A method for changing the position of a belt buckle in a support belt for lifting weight comprising the steps of:

placing said apparatus over said support belt, wherein said apparatus comprises a frame with proximal and distal end, and one or more protrusions located on said frame and said support belt comprises a tongue portion, a buckle, and one or more notches on said tongue portion;

inserting said one or more protrusions into said one or more notches, thereby attacking said grasping apparatus to said supporting belt; and loosening said support belt by exciting force capable of unbuckling said belt and remove said grasping apparatus.

6. The method of claim 5, wherein said grasping apparatus comprises at least one of metal, alloy, composite, polypropylene, high density polyethylene, polyvinyl chloride, polystyrene, and combinations thereof.

7. The method of claim 5, wherein said one or more protrusion(s) is adapted to take on a variety of shapes comprising round, square or otter polygonal forms.

8. The method of claim 5, wherein said one or more protrusions are positioned on opposite sides of said central member.

9. The method of claim 5, wherein said frame is in the form of a belt-buckle and comprises a central member, wherein the one or more protrusions are located on the central member.

10. The method of claim 5, wherein said frame is a bar.

* * * * *